US006089126A

United States Patent [19]

Teeter et al.

[11] Patent Number: 6,089,126

[45] Date of Patent: Jul. 18, 2000

[54] SIZE-ADJUSTABLE BELT WRENCH AND METHODS

[75] Inventors: Clair Teeter; Johnny R. Erickson, both of Malta, Id.

[73] Assignee: Clair Teeter, Malta, Id.

[21] Appl. No.: 09/074,664

[22] Filed: May 7, 1998

Related U.S. Application Data

[63] Continuation of application No. 08/464,302, Jun. 5, 1995, abandoned, which is a continuation-in-part of application No. 08/228,243, Apr. 14, 1994, abandoned.

[51] Int. Cl.[7] ..... B25B 13/52

[52] U.S. Cl. ..... 81/64; 81/3.43

[58] Field of Search ..... 81/64, 3.43, 65, 81/65.2, 68–70, 65.4, 124.4–124.6, 177.85

[56] References Cited

U.S. PATENT DOCUMENTS

| | | |
|---|---|---|
| 701,489 | 6/1902 | Love . |
| 714,610 | 11/1902 | Rawe . |
| 876,469 | 1/1908 | Martin et al. . |
| 1,077,591 | 11/1913 | Cameron . |
| 1,161,402 | 11/1915 | Mitchell, Sr. . |
| 1,299,511 | 4/1919 | Scharnberg . |
| 1,479,902 | 1/1924 | Ellison . |
| 1,513,164 | 10/1924 | Euverard . |
| 1,911,815 | 5/1933 | Deringer et al. . |
| 2,057,949 | 10/1936 | Hodson . |
| 2,132,207 | 10/1938 | Donovan . |
| 2,186,430 | 1/1940 | Richter . |
| 2,458,393 | 1/1949 | Loudfoot . |
| 2,481,055 | 9/1949 | Whitaker . |
| 2,771,802 | 11/1956 | Lewis . |
| 2,787,924 | 4/1957 | Hammer . |
| 3,465,622 | 9/1969 | Winans . |
| 3,631,747 | 1/1972 | Flor . |
| 3,678,788 | 7/1972 | Matti . |
| 3,962,936 | 6/1976 | Lewis . |
| 4,212,336 | 7/1980 | Smith . |
| 4,506,568 | 3/1985 | Aamodt . |
| 4,646,593 | 3/1987 | Robertson . |
| 4,750,389 | 6/1988 | Schuster . |
| 4,987,804 | 1/1991 | Greenawalt . |
| 5,090,274 | 2/1992 | Schaub . |

*Primary Examiner*—D. S. Meislin

*Attorney, Agent, or Firm*—Morriss, Bateman, O'Bryant & Compagni

[57] ABSTRACT

Adjustable size saddle type single loop belt wrenches are disclosed which do not bite sharply at a corner or the like into the side of an object comprising a flexible, non-metallic belt, both ends of which are free, but one end being equipped with a clasp-engaging stop. At least two ends of the belt pass in substantially parallel relation through the clasp which is also eyesight, in conjunction with a turning tool, to bias the belt circularly around an object to be turned. The rotation of the clasp with the tool is along an axis generally parallel to but offset from the axis of the object. Only a small angle of rotation is required whereby the stop engages the clasp and a flat or continuous surface of the clasp imposes a distributed load across the belt onto the object to be turned.

12 Claims, 8 Drawing Sheets

SIZE-ADJUSTABLE BELT WRENCH AND METHODS

RELATED APPLICATIONS

The present application is a continuation of U.S. patent application Ser. No. 08/464,302, filed Jun. 5, 1995, now abandoned which is a continuation-in-part application of U.S. patent application Ser. No. 08/228,243, filed Apr. 14, 1994, now abandoned.

BACKGROUND

1. The Field of the Invention.

The present invention relates generally to the field of belt, strap, or band wrenches and more particularly to side saddle type belt wrenches, and related methods, which wrenches are adjustable to fit virtually any size object to be turned, each comprising a novel turning clasp to insure low cost production, facile use without significant technical training, and which does not damage the object to be turned.

2. The Background Art.

Prior proposals for band, strap, belt or like wrenches can be classified into a number of specific types. One type consists of strap wrenches where the distal tip of a handle is required to bite against the object to be turned. Examples of such wrenches are found in U.S. Pat. Nos. 701,489, 876,469, 1,077,591, 1,161,402, 1,911,815, 2,057,949, 2,481,055, and 2,661,802.

Another category of belt, band, or strap wrenches comprise non-metallic flexible belts comprising two free ends, both of which must be pulled upon to size the loop placed around an object to be turned, following which a rachet or similar tool will turn a bite mechanism through which the two ends of the non-metallic flexible belt pass. Examples of this type of wrench are found in U.S. Pat. Nos. 3,962,936, and 4,987,804.

A third classification of such wrenches consist of single sized flexible non-metallic strap loop wrenches where both ends of the strap are fastened to a handle to be rotated, the rotation occurring either end-for-end, or around the longitudinal axis of the handle. Examples of this type of wrench are found in U.S. Pat. Nos. 3,678,788 and 4,646,593.

A fourth category of such wrenches comprise a single size steel or metal band wrench where both ends of the band are coupled to a toggle or similar mechanism which, when rotated by a wrench, cause some part of the wrench to sharply bite against the object to be rotated. Examples of such steel band wrenches are found in U.S. Pat. Nos. 3,465,622, and 5,090,274.

A fifth category of wrenches of the type in question comprise non-metallic flexible band wrenches, having an adjustable size where one belt end is anchored to a handle or like rigid member and the other belt or band end is manually displaceable and unattached. The free end passes though at least one handle slot or slot in a bracket or wrench-receiving mechanism. Examples of this type of wrench are found in U.S. Pat. No. 2,186,430, 2,787,924 and 4,750,389.

An additional category of strap wrenches includes a strap comprising two ends where both ends are enlarged to abut a handle, the strap comprising an object-engaging loop and a second hand-held loop used to vary the size of the object-engaging loop. An example of this type of wrench is found in U.S. Pat. No. 2,458,393.

A further prior proposal comprises use of two tools, one comprising a single size lid wrench comprising a wire band and a two part handle where part of one handle piece is serrated to engage and turn the lid. The second tool comprises a non-metallic flexible band wrench with the band anchored at one end and free at the other and where the distal tip of the handle was required to bite through the flexible band against the object held stationary by the second tool which the first tool turns the lid. An example of this two-tool approach is found in U.S. Pat. No. 1,299,511.

BRIEF SUMMARY AND OBJECTS OF THE INVENTION

In brief summary, the present invention comprises belt wrenches, and related methods, the wrenches being possessed of features which overcome or substantially alleviate problems associated with the prior art. The present invention comprises adjustable size, single loop belt wrenches which do not bite sharply into the side of the object to be turned and comprise a flexible, non-metallic belt, both ends of which are free and extend in substantially parallel relation through a belt biasing clasp. The clasp can be slid to an engaged position, wherein the clasp is rotated through a small angle imbalanced stiffness of one end of the belt as compared with the other. This causes a stop or wedge at one end of the belt to securingly and continuously abut the clasp at distal slot, thereby securing the belt in a restrained condition firmly around the object. The belt wrench will remain in this configuration ready for use, without further support by the user.

With the foregoing in mind, it is a primarily object of the present invention to overcome or substantially alleviate problems associated with the prior art.

Another object of importance is the provision of novel belt wrenches, and related methods, the wrenches being side-adjustable.

A further paramount object is the provision of novel belt wrenches of the side saddle type which remain in place without being supported by the hands of the user.

Another object of significance is the provision of a novel manually operable belt wrench which grasps and turns an object without sharply biting into the object.

It is a further valuable object of this invention to provide a novel belt wrench, and related methods, the wrench comprising a flexible, non-metallic belt, and a belt-receiving and tool-receiving clasp of one-piece construction.

An additional object of dominance is the provision of a novel belt wrench which comprises a belt clasp, which is turned around an axis generally parallel to but offset from the axis of the object to be turned.

Another principal object is the provision of a novel belt wrench, and related methods, the wrench comprising a single belt clasp-turning tool capable of use with one hand.

It is also an important object to provide a novel multiple size, single loop belt wrench comprising a single clasp of one-piece construction which both receive two lengths of the belt and non-rotatably accepts a turning tool for facile grasping and turning of an object to be tightened or loosened.

A further object is the provision of novel belt wrenches where each belt comprises two free ends with one end comprising a stop such that only manipulation of the belt elsewhere is required to remove slack, and rotation of a clasp with a tool biases the belt and clasp to an object for rotating the object to tighten or loosen the same.

Another significant object is the provision of a novel belt wrench comprising a stop at one end of the belt to firmly abut a one-piece clasp to accommodate transfer of force from a large surface region of the clasp to the object to be turned.

These and other object and features of the present invention will be apparent from the detailed description taken with reference to the accompanying drawings.

DETAILED DESCRIPTION OF THE PREFERRED EMBODIMENTS

Figure 1:
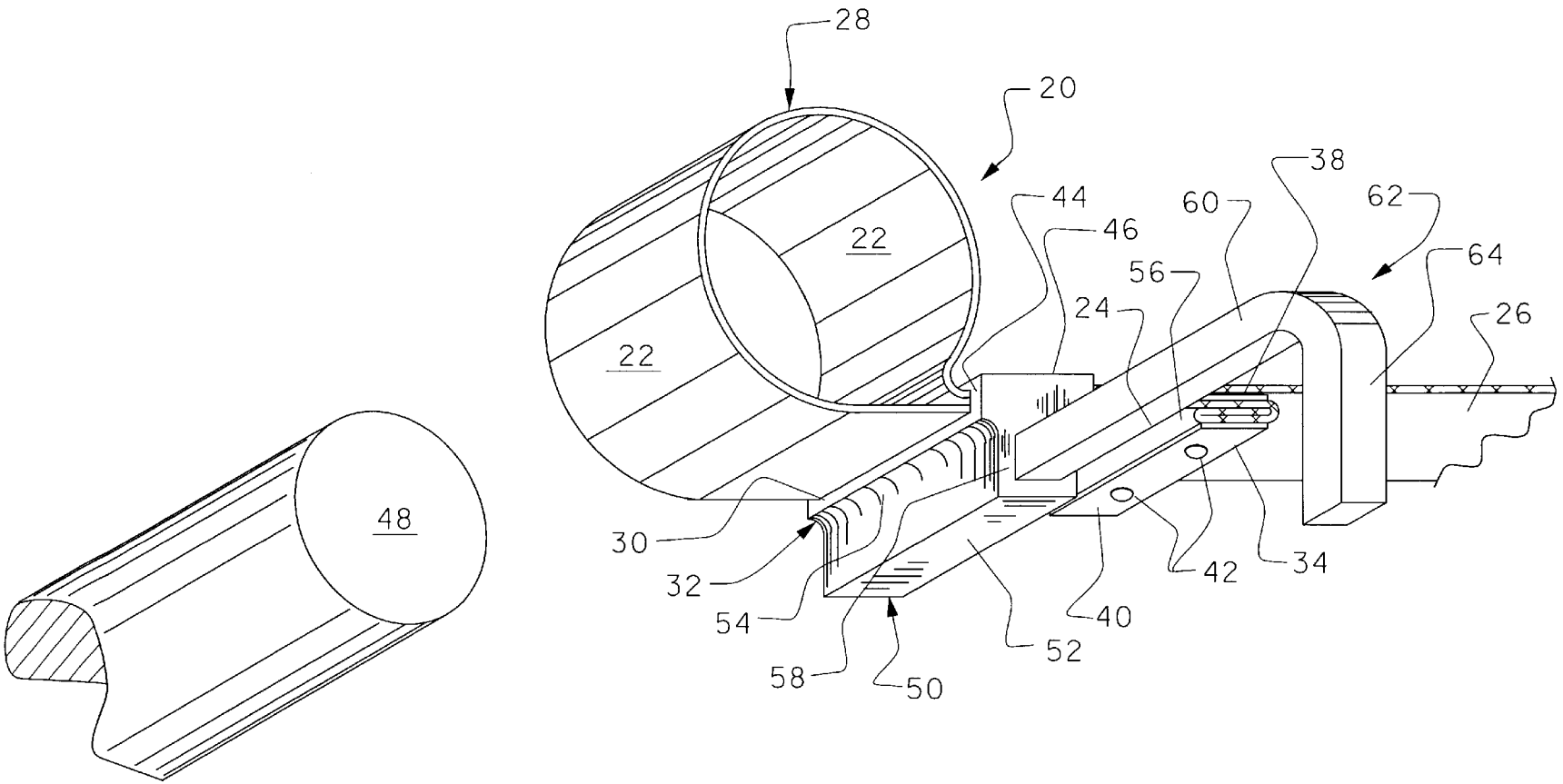
FIG. 1 is a perspective representation of one belt wrench embodying the principles of the present invention, positioned to be placed over a cylindrical object to be turned to loosen or tighten the same.

Reference is now made to the drawings wherein like numerals are used to designate like parts throughout. Particularly, initial reference is made to FIGS. 1 through 4, which illustrates a first belt wrench, generally designated 20, embodying principles of the present invention. Belt wrench 20 broadly comprises a belt 22 having two free ends a first end 24 and a second end 26. The belt 22 is illustrated as being relatively wide and thin. The belt 22 may be formed of any suitable material, for example canvas or woven synthetic fibers of any suitable synthetic resinous material, such as nylon may be used to form the belt. However, the present invention may involve use of any belt, strap, cord, or non-metallic band material in which a single loop 28 may be formed. Both lengths of the belt 22 extending away from the loop 28 pass through a single rectangular slot 30 in a clasp and turning, tool-receiving structure 32 of one-piece construction. The two lengths of the belt 22 are in substantially parallel relation as they pass through the rectangular slot 30 of the clasp 32.

The end 24 of the belt 22 comprises a stop or wedge, generally designated 35. The thickness of the wedge 34 substantially exceeds the area available in slot 30 for belt passage so that the wedge 34, when pulled form the position of FIG. 2 to the position of FIG. 3, for example, by manipulation of the free end 26, contiguously abuts the clasp surface 36 to prevent further displacement of stop 34.

In this way, wedge 34 seats against the distal edge of slot 30. Wedge 34 is thus employed to lock the second end 26 of belt 22 between the first end 24 and the distal edge of slot 30 thus securing belt 22. In this embodiment, stop 34 comprises the belt end 24 folded upon itself and side plates 38 and 40, which may be of steel, placed on opposite exposed sides of the fold and secured in position by doubled-headed rivets 42, which pass through aligned apertures in the plates 38 and 40. As will be appreciated a number of other configurations could be employed to serve the function of wedge 34. For example, the belt end may be doubled over as in FIG. 14, and stitched to form a stiff belt section with wedge 156 captured as shown.

The one pieced belt-receiving, tool-receiving, and biasing clasp 32 is, from the side, T-shaped in its configuration. It may be formed of any suitable rigid material, such as aluminum, steel, or high-strength synthetic resinous material. The clasp 32 comprises a distal edge 44, the proximal edge 36 mentioned above, a continuous flat side edge 46 for applying a well distributed force against an object 48 to be turned. While illustrated as being cylindrical, it should be apparent that other object configuration, such as polygonal shape, could be used. Surface 46 is constructed so as to avoid concentrated force transfer to the object 48, which would risk damage to the object 48.

The side of the clasp 32 opposite side 48 comprises a tool-receiving segment 50. Segment 50 comprises a base surface 52, which is flat and essentially parallel to surface 46, a front L-shaped surface 54 and a real L-shaped surface 56.

Segment 50 comprises a square socket or aperture 58, sized and shaped to receive, either permanently or removable, one leg 60 of a tool 62 tool, having a second leg 64 tool. It is to be appreciated that other tools, such as a rachet, could be used.

Figure 2:
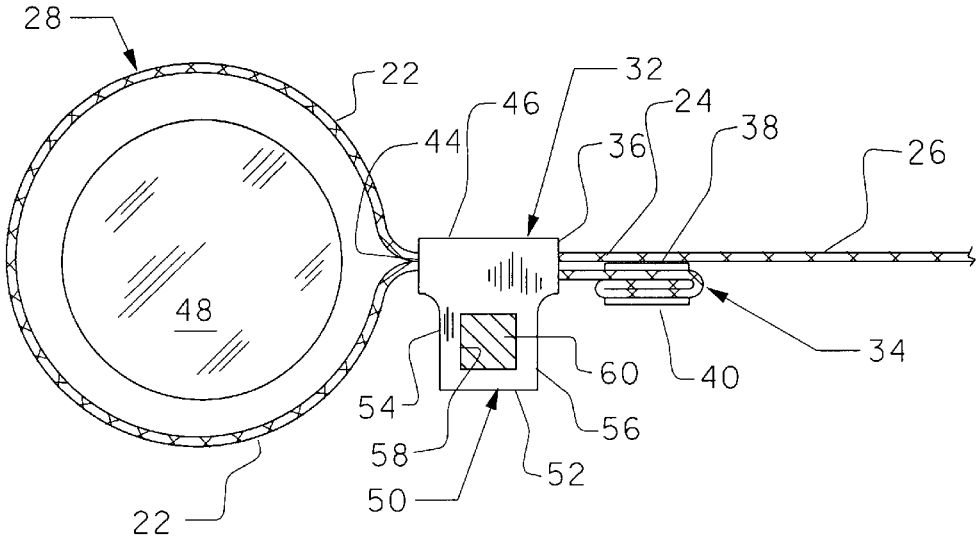
FIG. 2 is an elevational view of the belt wrench of FIG. 1 positioned so that a belt loop loosely surrounds the cylindrical object to be turned.

In operation, the size-adjustable loop 28 is positioned around the object to be turned, which can be an oil filter, the lid on a jar, or any other annular part which is placed or removed by rotation. FIG. 2 shows the loop 28 as having been loosely placed circumferentially around the object 48.

Figure 3:
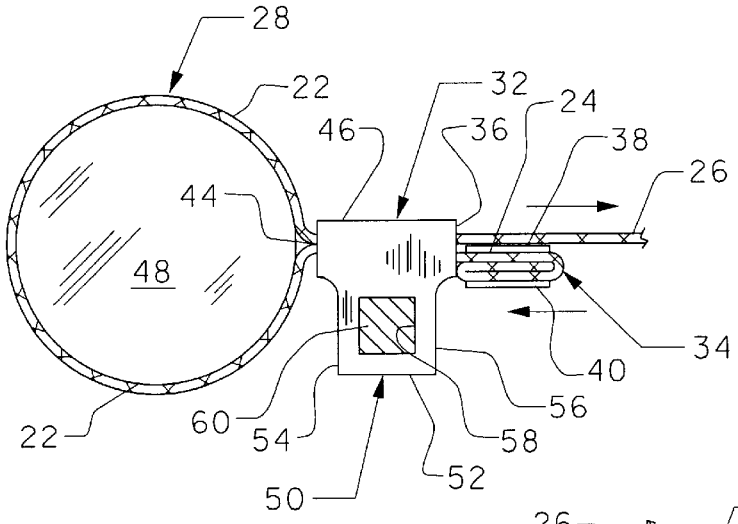
FIG. 3 is an elevational view of the belt wrench of FIG. 1 with a belt stop firmly abutting a single clasp and the belt in contiguous, tightened relation surrounding the cylindrical object.
Figure 4:
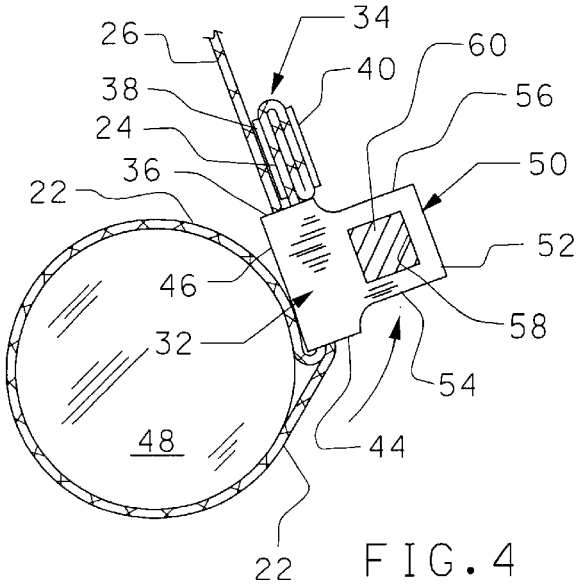
FIG. 4 is an elevational view of the belt wrench of FIG. 1 in contiguous, tightened relation surrounding the cylindrical object and the clasp of the wrench being rotated through slightly more than ninety degrees to tighten the wrench in preparation for rotating the cylindrical object.

The user next typically grasps the clasp 32 in one hand, while pulling on the free end 26 of the belt 22 until the noose of loop 28 becomes firmly contiguous with the circumference with the object 28, as illustrate in FIG. 3. This manipulation causes the stop 34 at belt end 24 to firmly and impassibly abut the trailing edge 36 of the claps 32. Once the position of FIG. 3 is attained, the free end 26 of the belt 22 is manually released. Nevertheless, the belt retains its tightened position on the can due to the gripping action of the clasp. The rotational tool 62, appropriately connected to the clasp, is then grasped by the user and rotated, causing the clasp to rotate through approximately 120° for the position of FIG. 3 to that of FIG. 4. This compressively biases the loop 28 against the object 48 at surface 46, places the lower leg of the loop in tension, and causes the force of rotation to be transferred, on a distributed load basis, across the surface 46 and the belt 22 to a substantial surface area of the object 48, as illustrated in FIG. 4.

It is to be appreciated that to place the object 48 in a tightened position, the orientation of the wrench 20 around the object 48 is reversed. In other words, the segment 50 would be above rather than below belt end 26, as viewed in FIG. 2, but the operation described above would nevertheless be applied to tightening the object 48 during placement. No risk of damage is incurred, assembly is facile, and turning is accommodated by any individual, even those without much if any technical training.

Reference is now made to the second belt wrench embodiment, generally designated 80, illustrated in FIGS. 5 through 13. Belt wrench 80 comprises belt 22' substantially identical to the previously described belt 22, except end 24 comprises a modified stop 34'. Stop 34 comprises folds of the belt held together by opposed plates and rivets, whereas stop 32' comprises the end 34 merely rolled or folded upon itself and stitched or otherwise secured in the rolled or folded fashion illustrated, without the benefit of side plates and rivets or other support structure. End 34' functions as a stop abutment to impassibly engage a clasp 32' forming a part of the belt wrench 80. The belt wrench 80 is illustrated as utilizing the previously described rotating or turning tool 62, the short leg 54 thereof being illustrated in FIG. 5 as being prepared to engage the tool-receiving portion of the clasp 32' instead of the longer leg 60, as illustrated in FIG. 1.

Figure 5:
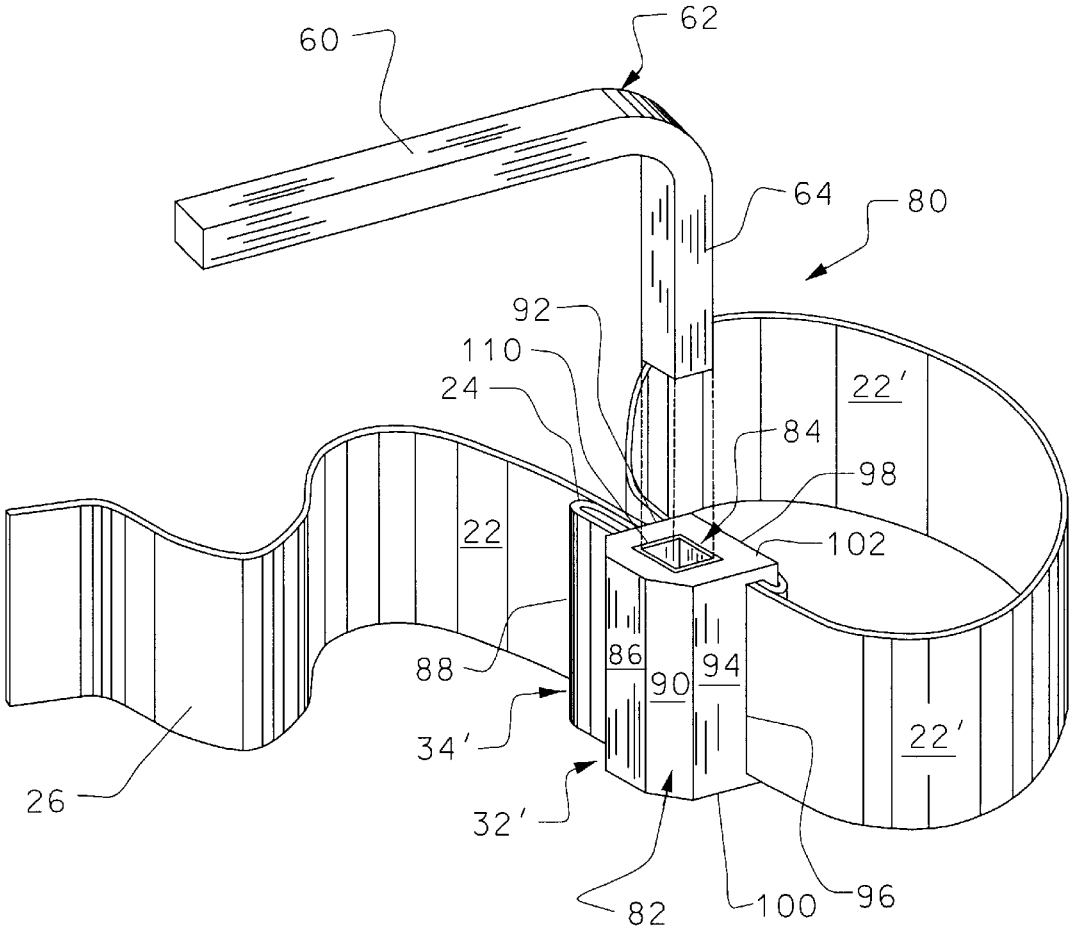
FIG. 5 is a perspective representation of a second belt wrench embodying the principles of the present invention.
Figure 6:
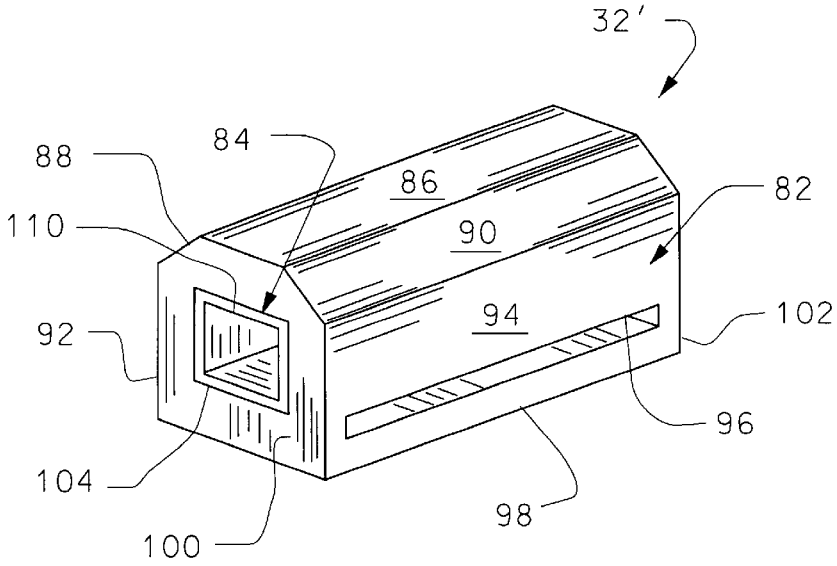
FIG. 6 is a perspective representation of a clasp forming part of the belt wrench of FIG. 5.
Figure 8:
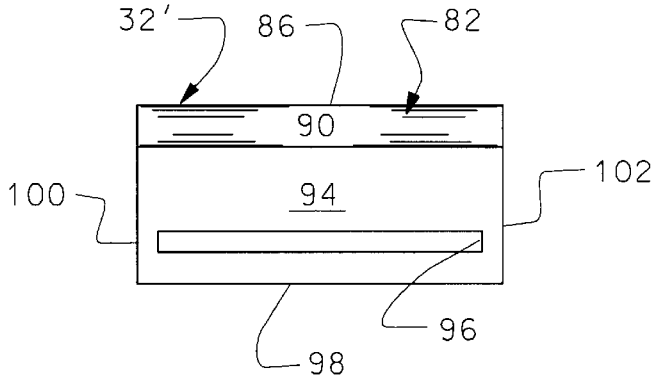
FIG. 8 is a front elevation of the clasp of FIG. 6.
Figure 7:
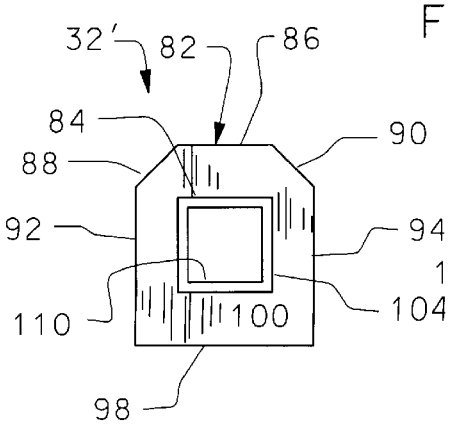
FIG. 7 is an end elevation of the clasp of FIG. 6.
Figure 9:
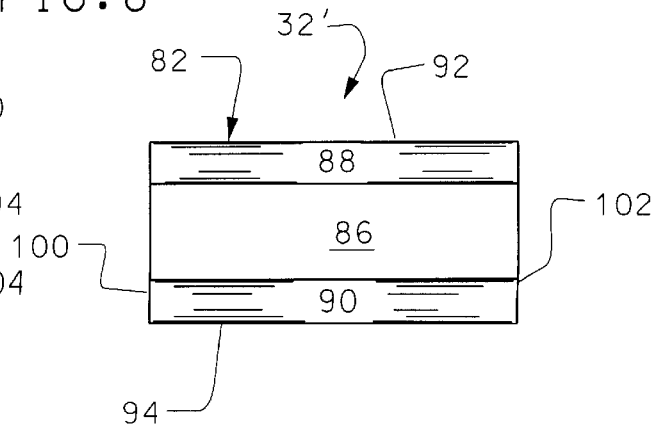
FIG. 9 is a top plan view of the clasp of FIG. 6.
Figure 10:
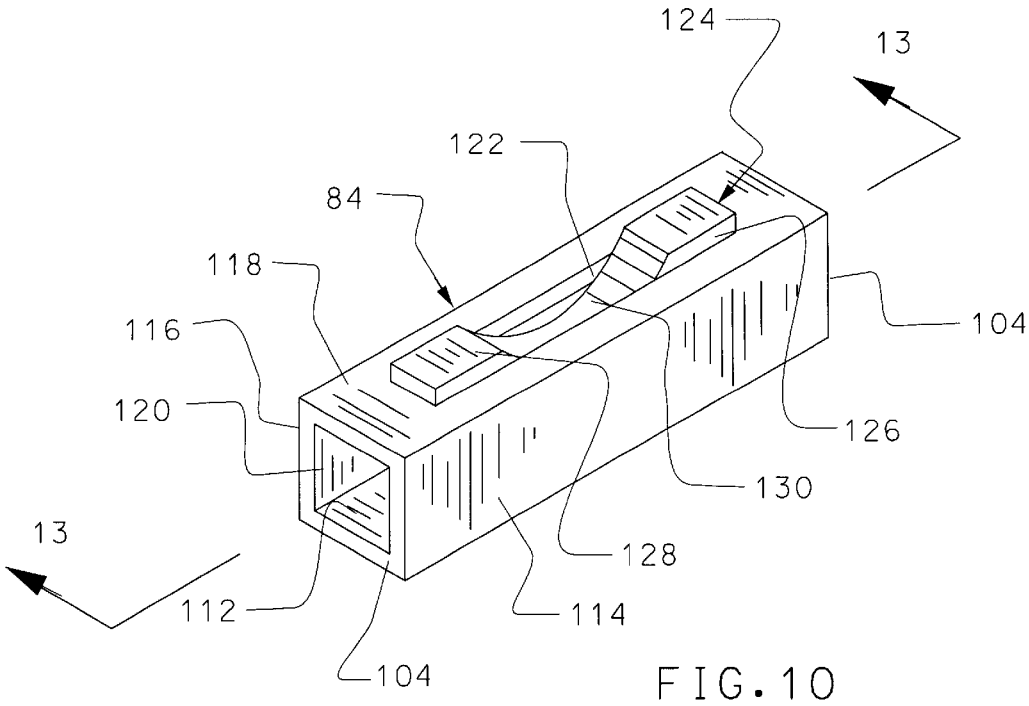
FIG. 10 is a perspective representation of an interior liner for the clasp illustrated in FIGS. 5–7.
Figure 12:
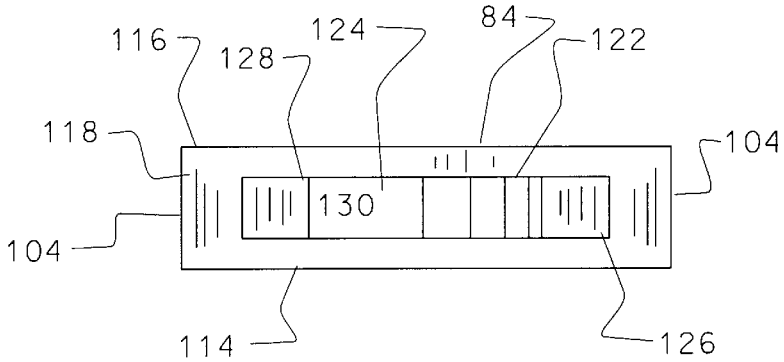
FIG. 12 is a top plan view of the clasp liner of FIG. 10.
Figure 11:
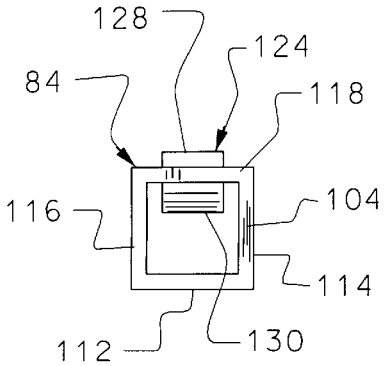
FIG. 11 is an end elevation of the clasp liner of FIG. 10.
Figure 13:
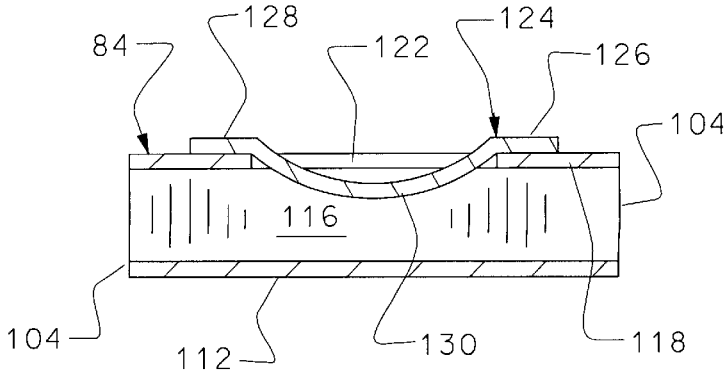
FIG. 13 is a cross-section taken along lines 13—13 of FIG. 10.

The clasp 32' comprises an outer housing, generally designated 82, and a liner, generally designated 84, contained within the housing 82. The housing 82 is preferably formed of high molecular weight, rigid synthetic resinous material. It has an external barn-like or house-like shape comprising a plurality of flat surfaces including a top exterior flat surface 86, diagonal surface 88 and 90 extending away from surface 86, opposed side surfaces 92 and 94, each interrupted by a rectangular slot 96 which passes completely through the housing 82 from the proximal side 94 to the distal side 92, the slot 96 being sized to accommodate slidable passage therethrough of two lengths of the belt 22', as illustrated in FIG. 5.

The exterior of the housing 82 also comprises a flat bottom surface 98, which forms a large continuous area by which force is applied in a distributed fashion and not as a concentrated load across a portion of the belt 22' against the object to be turned, in the manner previously described surface 46 of the clasp 32. The housing 82 also comprises opposed flat side surfaces 100 and 102, at which the end edges 104 of the inset or liner 84 are exposed.

The housing 82 is preferably formed using conventional injection molding techniques. The liner 84 may be positioned in the mold and the housing 82 cast around it, or, in the alternative, a side-to-side aperture, square in its configuration, may be created at site 110 and the insert or liner 84, preferably formed of steel, may be driven into the aperture 110 until positioned as illustrated if FIGS. 5 through 7. One suitable liner illustrated in FIG. 10 and comprises a hollow box comprising a thin bottom wall 112, thin opposed side walls 114 and 116, parallel one to the other, and a thin top wall 118, illustrated as being parallel to bottom wall 112. Together the four walls 112, 114, 116 and 118, formed as one-piece, define a square passageway or opening 120, sized to snugly receive either end 60 or 64 of the turning tool 62 to rotate the clasp 32' in the manner described above in conjunction with clasp 32.

Walls 112, 114, and 116 are illustrated as being continuous and uninterrupted. Top wall 118 is illustrated as being interrupted by a rectangular aperture 122. A leaf spring 124, preferably formed of spring steel, is illustrated as transversing the aperture 122 and as being secured to the wall 118 as by welding at opposed ends 126 and 128. Centrally, leaf spring 124 is bowed inwardly into passageway 120, but is deflected outwardly, for example, when one end of the turning tool 62 is inserted into the opening 120. Thus, leaf spring 122 at its center 130 biases as against the inserted end of the turning tool 62 in the inserted position against inadvertent removal, while accommodating intentional manual removal.

The placement of the belt 22' around an object to be turned, the tightening of the loop of the belt 22' and the operation of the wrench 80 by the turning tool 62 using clasp 32' is essentially as described in respect to the operation of the belt wrench 20.

Figure 14:
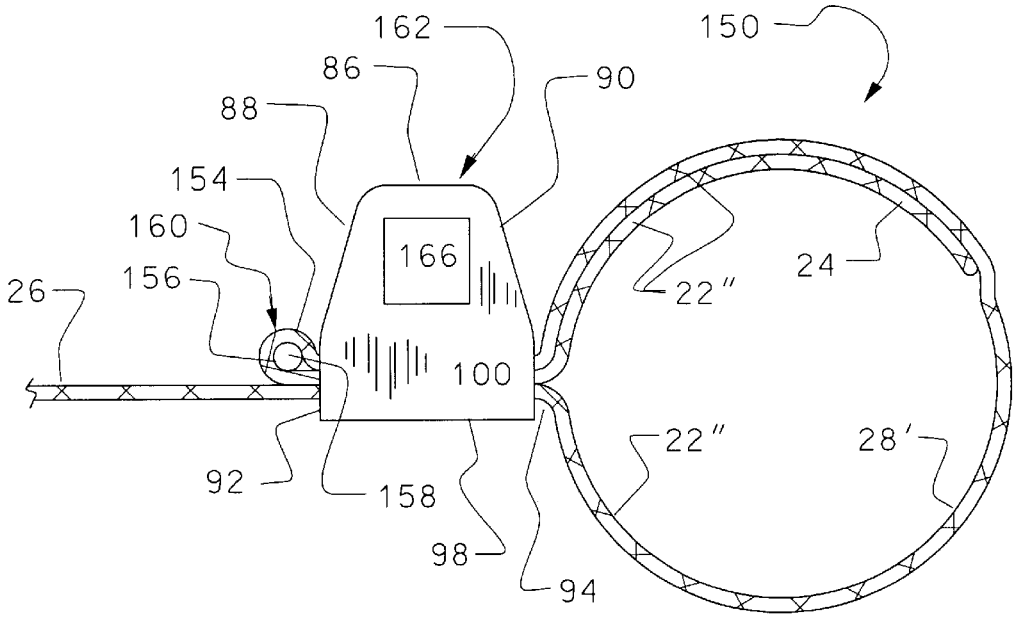
FIG. 14 is a side elevation of a third belt wrench embodying the principles of the present invention.
Figure 17:
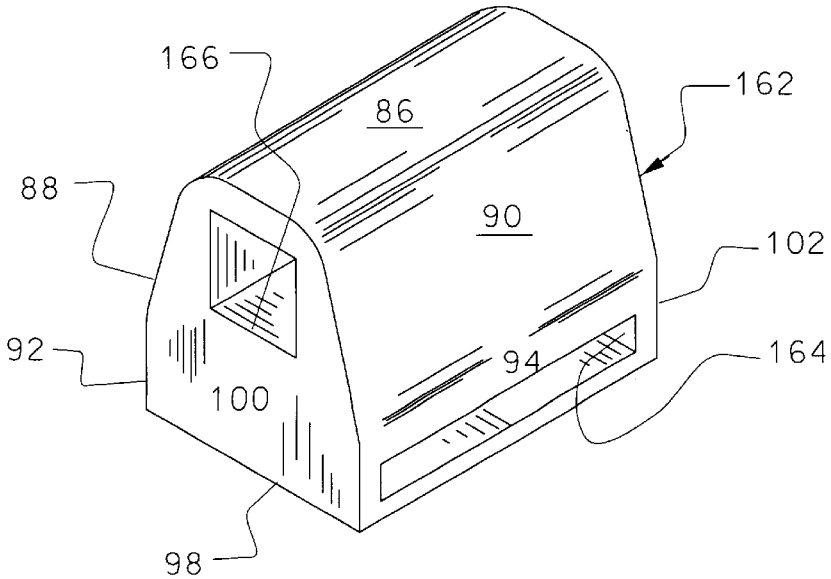
FIG. 17 is a perspective representation of a one-piece clasp comprising part of the belt wrench of FIG. 14.

Reference is now made to FIGS. 14 through 18 which illustrate a further belt wrench, generally designated 150. As depicted in FIG. 14, belt wrench 150 comprises a belt 22", which in most respects is substantially similar to previously described belt 22. Accordingly, belt 22" comprises a first end 24 and a second end 26. End 24 is doubled back upon itself so as to be contiguous with an adjacent or portion of the belt. The doubled back portion of end 24 is stitched at sites 152 in its doubled back position was illustrated best in FIGS. 14 and 16. The doubled back nature of the end 24 defines an eyelet 154, which comprises a transverse opening 156, into which a pin 158 is force-fit. The eyelet 154, aperture 156, and pin 158 collectively comprises a stop, generally designated 160, the thickness of which prevents the stop 160 from passing through a clasp, generally designated 162.

Because of the double back construction of the distal end 24 of the belt 22", as explained above, three lengths of the belt 22" pass through the clasp 162 at rectangular through slot 164. The doubling back of end 24 provides a stiff portion which extends through the proximal end of slot 164. The stiff portion of end 24 of belt 22" also extends through a short radius of curvature into the loop formed in belt 22". The stiffness of belt 22" extending into loop 28' imposes a biasing stress which serves to cock loop 28' to one side as shown.

Figure 15:
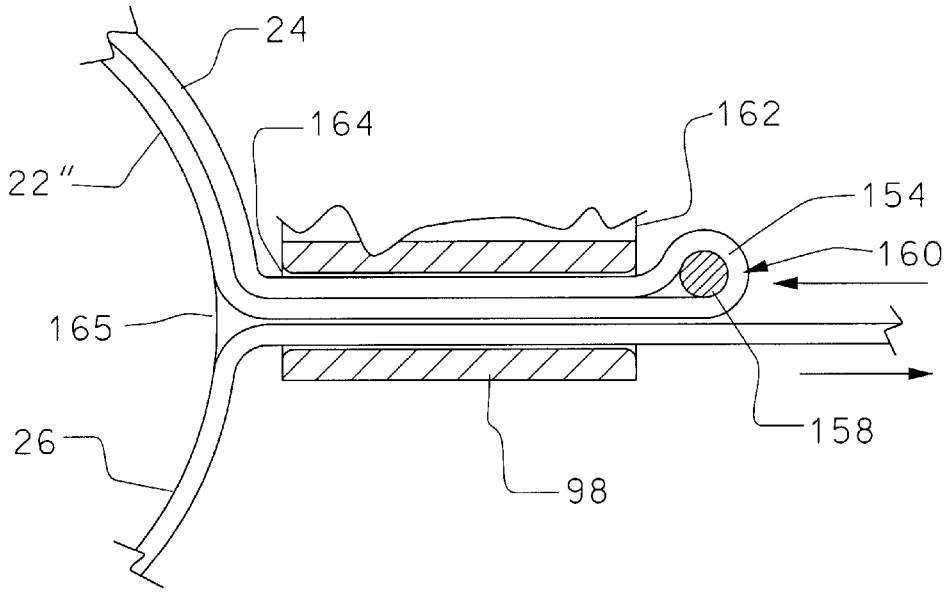
FIG. 15 is an enlarged side view of the third belt use of the wrench.
Figure 16:
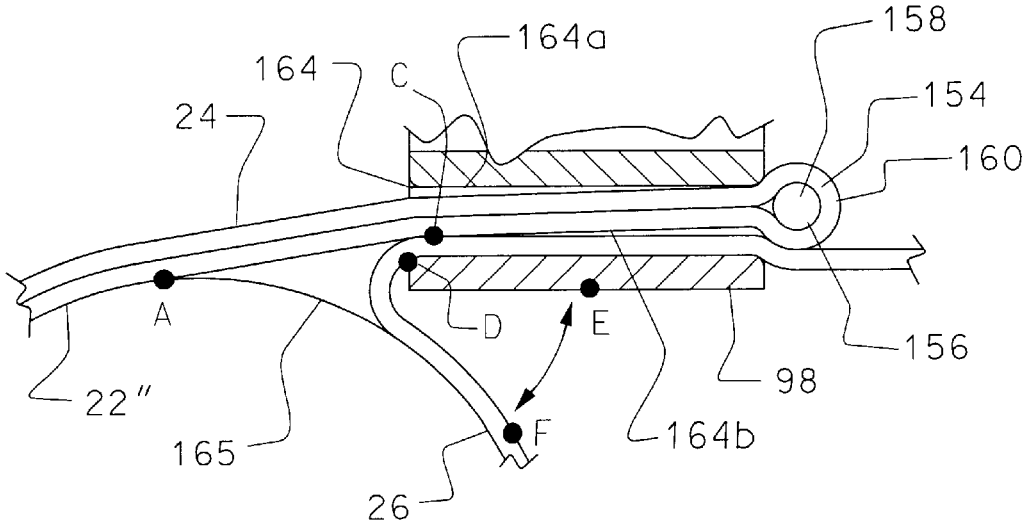
FIG. 16 is an enlarged side view of the third belt wrench depicted the forces around the illustrated points involved in use of the wrench.

FIGS. 15 and 16 illustrate the biasing stress and associated effects in greater detail. In FIG. 15 the proximal end 26 of belt 22" having a single thickness, is depicted as it would appear when pulled tight. Pulling the proximal end 26 of belt 22" tight draws stop 160 into slot 164 which is formed by opposing sidewalls **164*a* and 164*b*. This action wedges the proximal end 26 of belt 22" between clasp 162 and stop 160, and the side of the stop opposite the proximal end of the belt 22" is wedged against the other sidewall. Thus, a wedge is formed by the engagement between the stop 160 and both sidewalls 164*a* and 164*b* defining the slot 164. This wedge acts as a lock thereby holding the belt wrench 150** in place on the object to be turned.

FIG. 16 further illustrates the forces involved in the locking action mentioned above. In instances where there is less than 45° of motion toward stop 160, clasp 162, exerts tension on stop 160 by increasing the distance from Point A to Point B by hinging over Point D. As shown, Point A is the point where the distal, doubled back, end 24 of belt 22" first contacts the object to be turned 165. Point B is the point where the doubled back end 24 begins to widen to form eyelet 154 into which pin 158 is fit to form stop 160. Stop 160 wedges into slot 164 of clasp 162 at Point B. This wedging effect exerts pressure on the proximal end 26 of belt 22" which serves to lock the belt wrench 150 in place around object 165, thus preventing movement of the proximal end of belt 22" toward Point A.

The distal end 24 of belt 22" then exerts pressure against the proximal end, single thickness portion, at Point C due to the 45° motion described above thus increasing the distance between Point A and Point B. This action creates tension at Point C which serves as an additional force binding the proximal end 26 of belt 22" against clasp 162 preventing movement toward Point A. The proximal end 26 of belt 22" at Point D is thus forced toward Point A by folding under at Point C. Point E then contacts Point F in 90 degrees of motion further binding the proximal end 24 of belt 22". Reversing the motion of clasp 162 relaxes the tension and forces exerted at Points A, B, C, and D letting the belt wrench 150 slip in the opposite direction thus creating a ratcheting effect.

The clasp 162 is preferably formed of rigid, high-strength synthetic resinous material, forced using conventional injection molding techniques. The clasp 162 is somewhat similar to clasp 32', being housed or barn-shaped, but being without a liner of insert and comprising rounded corners between flat exposed surface area. The exterior wall surface configuration of the insert 162 being substantially the same as that of clasp 32', except for dimensional differences and rounded corners, the exterior surfaces of clasp 162 have been numbered identical to the exterior surfaces of clasp 32' and no further description thereof is deemed necessary.

The depth of the belt-receiving rectangular slot 164 is slightly greater than three times the thickness of the belt 22' and slightly greater than the width of the belt 22'. A transverse, centrally disposed square opening 166 is sized so as to receive one end of a tool for rotational purposes, such as previously described tool 62. Sharp edges are provided to assist in gripping the belt when cocked to one side.

As explained earlier, the bottom surface 98 has a substantial area and, therefore, the rotational force applied by a tool such as tool 62 to the clasp 162, with the loop 28' snug, will turn the clasp through slightly greater than 90° until the bottom surface 98 is contiguous with a portion of the exterior surface of the belt 22', at the loop 28' thereof. Further turning biases the other leg of the loop 28' and generates a force against the object to be turned imposed by the bottom surface 98 through the belt 22' which is well-distributed and not concentrated, accommodating turning of the object with little if any risk that the object will be damaged in the process.

Figure 19:
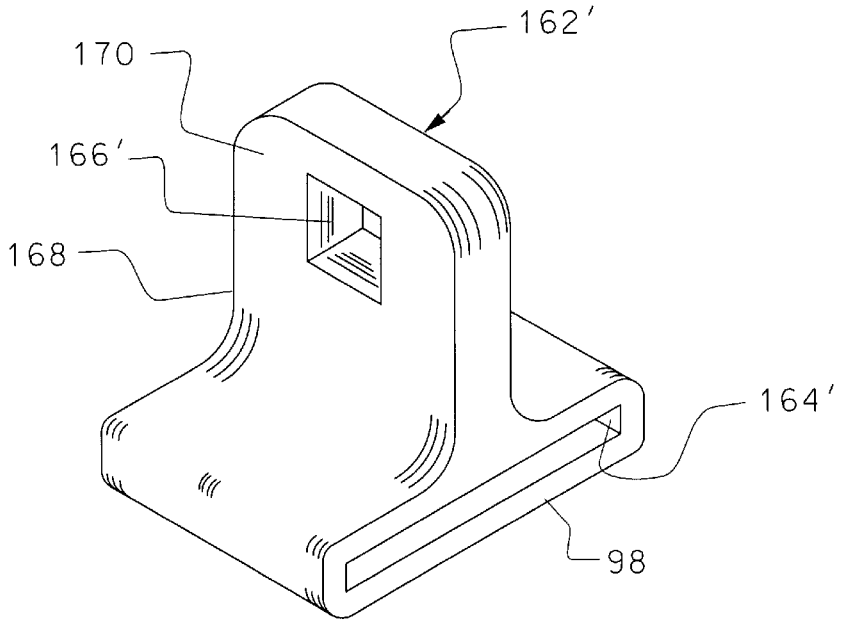
FIG. 19 is a perspective view of an alternative embodiment of the clasp of the present invention.
Figure 18:
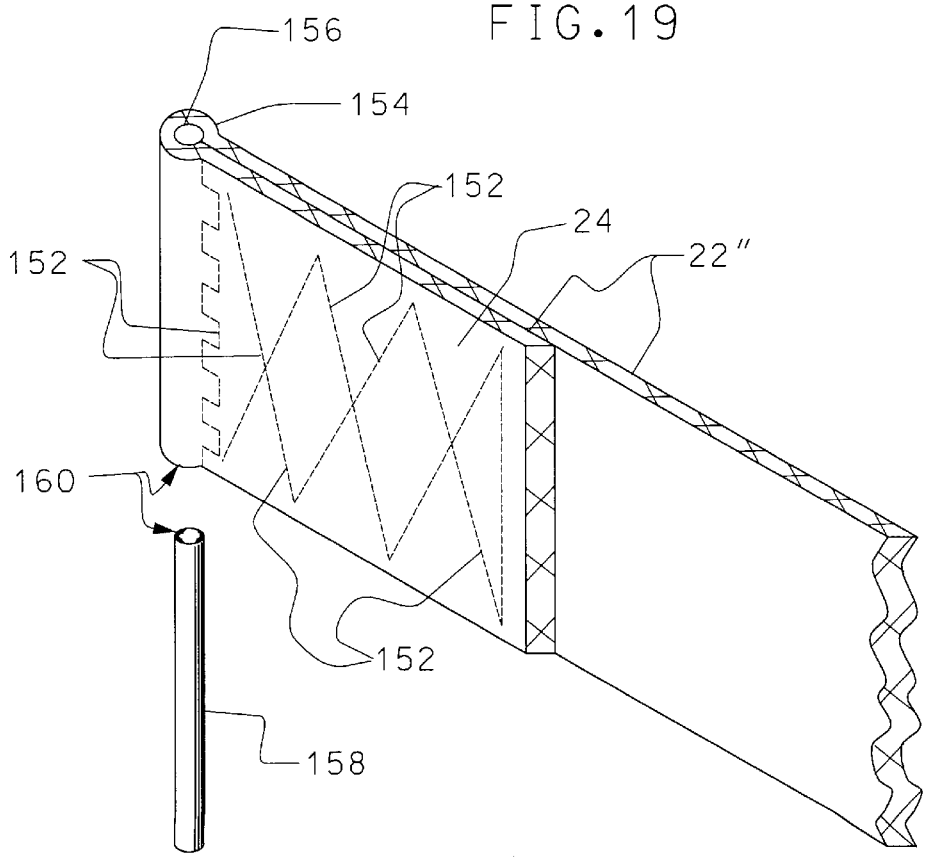
FIG. 18 is an enlarged fragmentary exploded perspective of one end of the belt of FIG. 14 comprising a clasp-engaging stop.

FIG. 19 illustrates an alternative embodiment of the clasp, generally designated as 162'. Clasp 162' is designed to require less material to manufacture. Clasp 162' incorporates slot 164' and square opening 166' which is sized so as to receive one end of a tool for rotational purposes.

In this embodiment, clasp 162' employs a housing 168 which employs a design requiring less material to implement the previously described embodiments. Clasp 162' employs a thin protrusion 170 in which square opening 166' is incorporated. Protrusion 170 is formed to be perpendicular to and substantially centered over slot 164'. This design results in a more streamlined clasp requiring less material for manufacture.

The invention may be embodied in other specific forms without departing from the spirit of essential characteristics thereof. The present embodiments therefore to be considered in all respects as illustrative and are not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. An adjustable size belt wrench comprising:

a belt having a first end and a second end, said belt forming a loop partway between said first end and said second end to be placed circumferentially around an object;

a clasp means for adjusting said loop in said belt, said clasp means having a slot defined by opposing sidewalls for slidably receiving said first end and said second end of said belt, said opposing sidewalls of said clasp means having a distal end remote from the loop, a proximal end close to the loop, the clasp means further comprising a contacting side for being pressed against the portion of the belt forming the loop;

said clasp means being moveable into a hand-tightened position wherein said clasp means is manipulated to adjust the diameter of said loop to the outside diameter of the object by advancing said first end and said second end of said belt through said slot until said clasp means and loop are firmly contiguous with the circumference of the object;

a wedge means formed in said first end of said belt and being disposed for seating along a plane which extends between the opposing sidewalls at the distal end of the slot, the wedge means comprising a pin sized to force the first end of the belt to engage the distal end of one sidewall and to force the second end to engage the distal end of an opposing sidewall when forced toward the clasp means to lock the second end of said belt between the first end of the belt and the clasp means;

said clasp means including a tool receiving segment disposed therein for receiving a rotational tool means for rotating said clasp and to rotate the object in response to the rotation of the tool; and wherein the wedge means is arranged such that tightening of the belt causes the pin to travel toward the distal ends of the opposing sidewalls and to force the first and second ends into engagement with the distal ends of the opposing sidewalls.

2. An adjustable size belt wrench as defined in claim 1 wherein said wedge means comprises a pin disposed within an eyelet formed in said first end of said belt.

3. An adjustable size belt wrench as defined in claim 2 wherein said pin is substantially cylindrical.

4. An adjustable size belt wrench as defined in claim 2 wherein said pin is substantially rectangular.

5. An adjustable size belt wrench as defined in claim 2 wherein said pin is manufactured of metallic material.

6. An adjustable size belt wrench as defined in claim 1 wherein said wedge means comprises a portion of said first end of said belt which has been folded over upon itself, said portion employing securing means for securing said portion in said folded configuration.

7. An adjustable size belt wrench comprising:

a belt having a first end and a second end, said belt forming a loop partway between said first end and said second end to be placed circumferentially around an object;

a clasp means for adjusting said loop in said belt, said clasp means having a slot defined by opposing sidewalls for slidably receiving said first end and said second end of said belt, each of the opposing sidewalls having a distal end remote from the loop and a proximal end adjacent the loop, the clasp means further comprising a substantially flat bottom surface for being pressed against the belt and contained object;

said clasp means being movable into a hand-tightened position wherein said clasp means is manipulated to adjust the diameter of said loop to the outside diameter of the object by advancing said first end and said second end of said belt through said slot until said clasp means and loop are firmly contiguous with the circumference of the object;

a stop formed in said first end of said belt, the stop being sufficiently large to force the first end into engagement with the distal end of one sidewall and the second end to engage an opposing sidewall to prevent the first end of said belt means from being pulled through the slot when clasp means is rotated relative to the loop, and to lock the second end of said belt between the distal end of a sidewall and the stop, the stop comprising a pin disposed in the first end of the belt to force the first end against one sidewall and the second end against the opposing sidewall at the distal edge when the clasp means is rotated and when the second end of the belt is pulled away from the loop;

the first end of the belt further comprising a stiff portion extending from the stop, through the proximal end of the slot and through a short radius of curvature substantially into said loop formed between said first end and said second end of said belt to thereby impose a biasing stress thereby cocking said loop to one side where said stiff portion extends past said clasp; and said clasp means including a tool receiving segment disposed therein for receiving a rotational tool to rotate said clasp and to rotate the object in response to the rotation of the tool.

8. An adjustable size belt wrench as defined in claim 7 wherein said stiff portion extends at least 1 inch into said loop.

9. An adjustable size belt wrench as defined in claim 7 wherein said pin is substantially cylindrical.

10. An adjustable size belt wrench as defined in claim 7 wherein said pin is manufactured of metallic material.

11. An adjustable size belt wrench as defined in claim 7 further including a wedge means, wherein said wedge means comprises a portion of said first end of said belt in a layered configuration.

12. An adjustable size belt wrench comprising:

a clasp having a proximal side for disposition adjacent an object to be moved and a distal side opposite the contacting side, and a pair of opposing sidewalls disposed in the clasp so as to define a slot extending from the proximal side to the distal side;

a means for applying torque to the clasp;

a belt having a first end and a second end, said belt forming a loop partway between said first end and said second ends, whereby said loop is adjustable for placement circumferentially around an object, the first end and second end extending through the slot, and terminating on a side of the slot opposite the loop; and a wedge means formed in the first end of the belt for inhibiting the first end of the belt from being drawn through said slot, the wedge means sized to force the first end of the belt to engage one sidewall of the clasp and to force the second end to engage an opposing sidewall when forced toward the clasp to lock the second end of said belt between the first end of the belt and the clasp.

* * * * *